US006354897B1

(12) United States Patent
Palevsky et al.

(10) Patent No.: US 6,354,897 B1
(45) Date of Patent: Mar. 12, 2002

(54) FIELD EMISSION DISPLAYS AND MANUFACTURING METHODS

(75) Inventors: Alan Palevsky, Wayland; Todd R. Gattuso, Framingham; Peter F. Koufopoulos, Millis; James M. McGrath, South Yarmouth, all of MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/447,070

(22) Filed: Nov. 22, 1999

Related U.S. Application Data

(62) Division of application No. 08/918,023, filed on Aug. 25, 1997, now abandoned.

(51) Int. Cl.[7] ..... H01J 9/00
(52) U.S. Cl. ..... 445/24; 445/47
(58) Field of Search ..... 445/24, 47; 313/309, 313/497

(56) References Cited

U.S. PATENT DOCUMENTS 4,442,376 A * 4/1984 Van Der Waal et al. .... 313/402
5,012,482 A 4/1991 Gray ..... 313/309 X
5,514,847 A 5/1996 Makishima et al. .... 313/309 X
5,541,473 A * 7/1996 Duboc, Jr. et al. ..... 313/422
5,543,691 A 8/1996 Palevsky et al. ..... 313/309 X
5,717,275 A 2/1998 Takemura ..... 313/309
5,723,867 A 3/1998 Imura ..... 313/309 X
5,763,987 A * 6/1998 Morikawa et al. ..... 313/309
5,814,926 A * 9/1998 Tomihari ..... 313/309

* cited by examiner

*Primary Examiner*—Kenneth J. Ramsey
*Assistant Examiner*—Todd Reed Hopper
(74) *Attorney, Agent, or Firm*—Daly, Crowley & Mofford LLP

(57) ABSTRACT

A field emission display having a plurality of cathodes; a cathodoluminescent anode; a plurality of control electrodes for controlling the flow of electrons between the cathodes and the anode; a focus grid comprising an apertured, conductive sheet; and a dielectric material is disposed on the focus grid between the conductive sheet and the control electrodes. With such an arrangement, the dielectric material prevents the focus grid from electrically contacting the control electrodes. Further, it has been discovered that high angle electrons emitted by each pixel are inhibited from passing through the focus grid associated with an adjacent pixel to reduce cross-talk. It is believed that surface charge forms on the dielectric material and acts as an additional focusing structure that reduces the number of high angle electrons emitted from one pixel from passing through an adjacent focus grid aperture resulting in a "cross-talk" image on the cathode. In another embodiment, the dielectric layer is disposed between, and in contact with, the focus grid and the cathode structure to provide an integral structure which prevents contact between the surface of the focus grid and the gate electrodes. A method is provided for forming a grid for a field emission display. The method includes the step of spraying a dielectric material towards a surface of the grid while a vacuum draws the spray from the surface through apertures in the grid.

4 Claims, 7 Drawing Sheets

FIELD EMISSION DISPLAYS AND MANUFACTURING METHODS

This is a divisional patent application of U.S. patent application Ser. No. 08/918,023, filed Aug. 25, 1997 which is pending, now abandoned.

BACKGROUND OF THE INVENTION

This invention relates generally to field emission displays and manufacturing methods, and more particularly to field emission displays having focus grids.

As is known in the art, field emission displays (FEDs) include an array of field emitting cathodes, an array of control, or gate electrodes, and a cathodoluminescent anode. Each one of the control electrodes is associated with a corresponding display pixel and controls the flow of electrons between the cathodes and the corresponding anode pixel. In a monochromatic array, each pixel corresponds to either a so-called "black" or "white" display luminescence; in a color display each pixel corresponds to a luminous blend of a plurality of, typically three colors.

In order to achieve a relatively bright display, (i.e., up to the order of 10,000 foot lamberts) with typical cathodoluminescent efficiencies, a voltage in the order of 10,000 volts is required between the cathode and anode. In order to reduce the effect of electron beam spreading and its concomitant reduction in picture resolution, cathode to anode separations of less than 3–4 millimeters are required. However, in order to prevent arcing between the anode and cathode with 10,000 volts therebetween, an anode to cathode separation in the order of 3–4 millimeters, or greater, is required. Thus, a compromise must be made between resolution and brightness.

SUMMARY OF THE INVENTION

In accordance with the present invention, a field emission display is provided having a plurality of cathodes; a cathodoluminescent anode; a plurality of control electrodes for controlling the flow of electrons between the cathodes and the anode; a focus grid comprising an apertured, conductive sheet; and a dielectric material disposed on the focus grid between the conductive sheet and the control electrodes.

With such an arrangement, the dielectric material prevents the focus grid from electrically contacting the control electrodes.

In accordance with another feature of the invention, a field emission device is provided comprising a cathode having an array of pixels. Each pixel has a plurality of field emitters and corresponding gate electrodes to emit electrons. An anode is distally disposed with respect to the cathode. A focus grid is disposed between the anode and the cathode. The focus grid has an array of apertures. Each aperture is disposed coaxial with a corresponding pixel of the cathode to focus electrons from the plurality of field emitters of the pixel of the cathode toward the anode. A dielectric material is disposed on a surface of the focus grid facing the gate electrodes to prevent electrical contact between the surface of the focus grid and the gate electrodes. Further, it has been discovered that high angle electrons emitted by each pixel are inhibited from passing through the focus grid aperture associated with an adjacent pixel to eliminate cross-talk. It is believed that surface charge forms on the dielectric material and acts as an additional focusing structure that reduces the number of high angle electrons emitted from one pixel that pass through an adjacent focus grid aperture and impinge upon the anode far from the desired location.

In accordance with another feature of the invention, a field emission device is provided comprising a cathode having an array of pixels. Each pixel has a plurality of field emitters and corresponding gate electrodes formed as a cathode structure to emit electrons. An anode is distally disposed with respect to the cathode. A focus grid is disposed between the anode and the cathode. The focus grid has an array of apertures. Each aperture is disposed coaxial with a corresponding pixel of the cathode to focus electrons from the plurality of field emitters of the pixel of the cathode toward the anode. A dielectric layer is disposed between, and in contact with, the focus grid and the cathode structure to provide an integral structure which prevents contact between the surface of the focus grid and the gate electrodes. Further, the dielectric layer prevents high angle electrons emitted by each pixel from passing to the anode as electrons emitted from an adjacent pixel. Still further, the focus grid and the array of pixels are a unitary structure so that the focus and cathode structure cannot move relative to each other.

In accordance with another feature of the invention, a method is provided for forming a grid for a field emission display. The method includes the step of spraying a dielectric material towards a surface of the grid while a vacuum draws the spray from the surface through apertures in the grid.

BRIEF DESCRIPTION OF THE DRAWING

FIG. 6A showing the cross talk without any dielectric on the focus grid and FIG. 6B showing the removal of such cross-talk when a dielectric material is applied to the focus grid;

DESCRIPTION OF THE PREFERRED EMBODIMENTS

Figure 1:
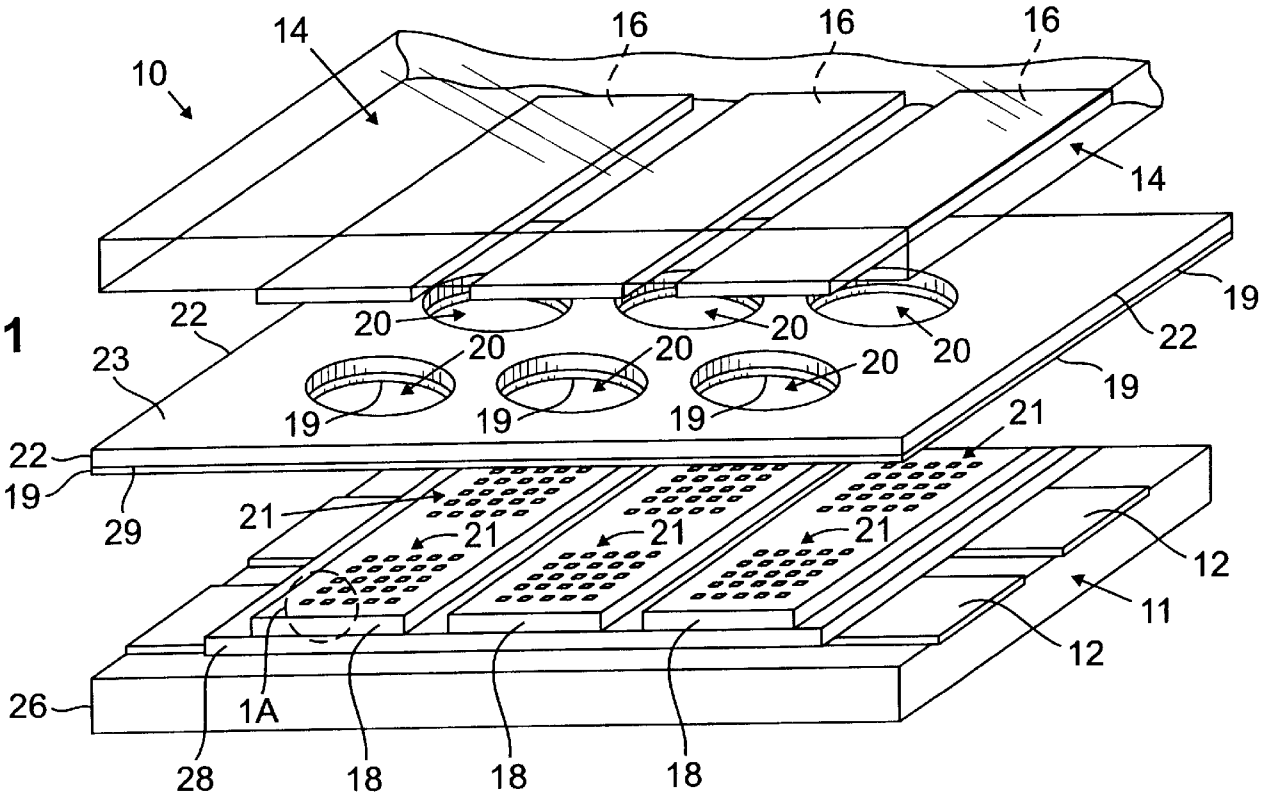
FIG. 1 is an isometric sketch of a field emission display according to the invention, a portion of field emitters thereof being shown in an enlarged view.
Figure 1A:
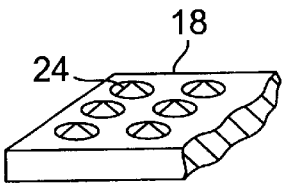
FIG. 1A is an enlarged view of a portion of the display of FIG. 1, such portion being enclosed by dotted lines in FIG. 1.

Referring now to FIGS. 1, 1A, 2 and 3, a field emission display 10 is shown. The field emission display includes: a cathode structure 11 having an array of pixels 21. Each pixel 21 has a plurality of field emitters 24 and corresponding gate electrode 18 to emit electrons. An anode 14 is distally disposed with respect to the cathode structure 11. A focus grid 22 is disposed between the anode 14 and the cathode structure 11. The focus grid 22 comprises a conductive sheet 23, here a nickel-iron alloy 150 microns thick, has an array of apertures 20. This conductive sheet 23 may be made out of two sheets, each 75 microns thick. The sheet, or sheets, as the case may be, have the array of apertures 20 photolithographically formed therein. Each aperture 20 is disposed coaxial with a corresponding pixel 21 of the cathode structure 11 to focus electrons from the plurality of field emitters 24 of the pixel 21 of the cathode structure 11 toward the anode 14. A dielectric material 19 is disposed, in a manner to be described, on a surface 29 of the focus grid 22 facing the cathode structure 11 to prevent electrical contact between the surface 29 of the focus grid 22 conductive sheet 23 and the gate electrodes 18. The thickness of the dielectric material 19 is here 12.5 to 25 microns. Further, it has been discovered that high angle electrons emitted by each pixel 21 of the cathode structure 11 are inhibited from passing to the anode 14 as if the electrons were emitted from an adjacent pixel 21. It is believed that surface charge forms on the dielectric material 19 and acts as an additional focusing structure that reduces the number of high angle electrons from one pixel 21 from crossing to the adjacent pixel 21.

Figure 2:
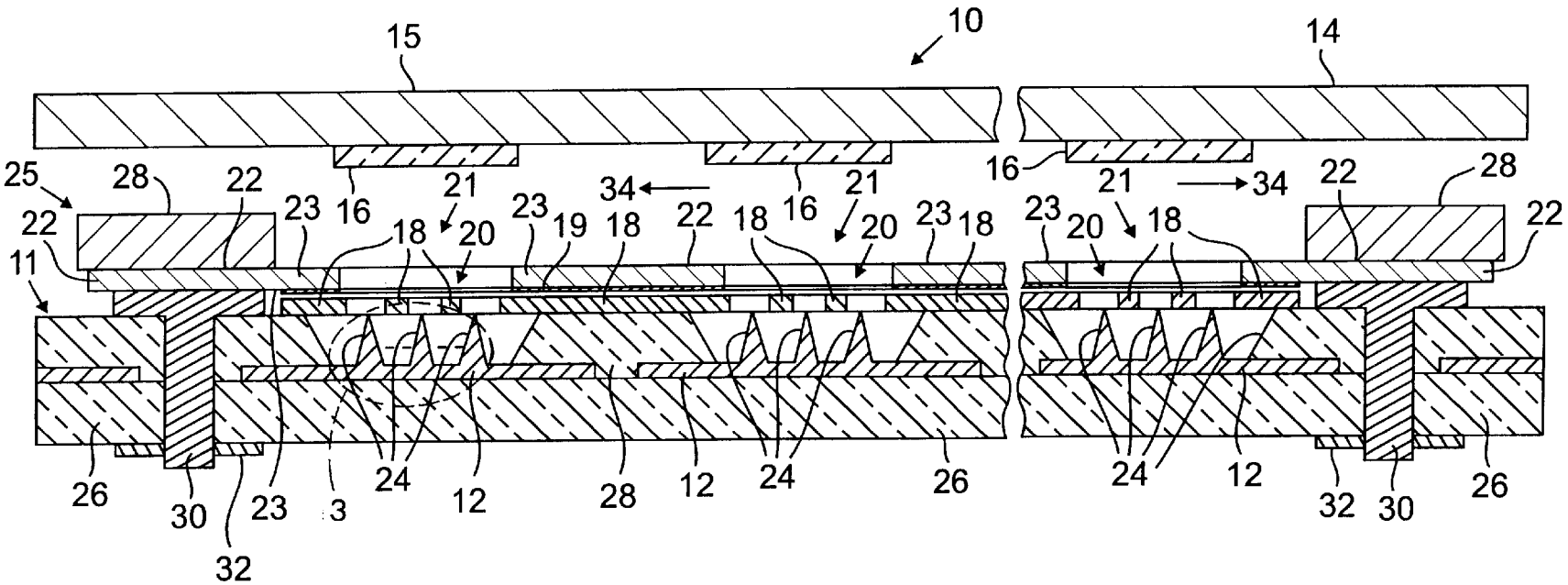
FIG. 2 is a cross-section, diagrammatical sketch of the field emission display of FIG. 1.
Figure 3:
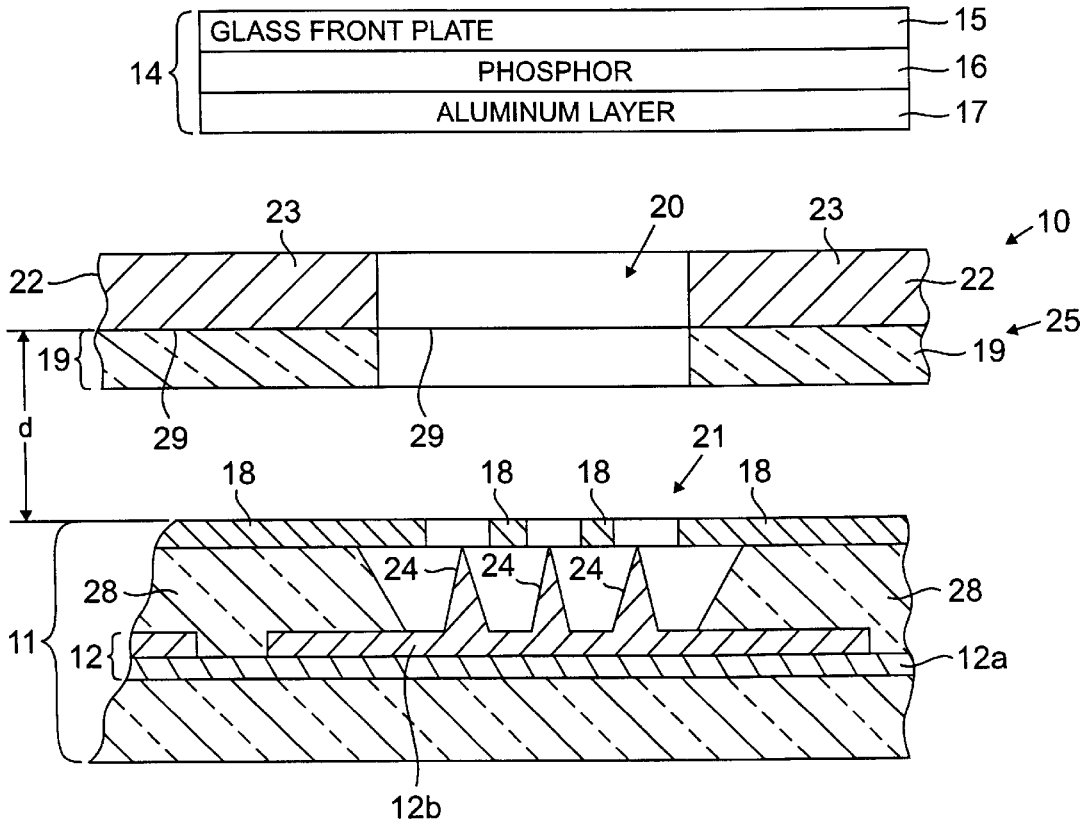
FIG. 3 is an enlarged portion of the display of FIG. 2, such portion being enclosed by line 3—3 in FIG. 2.
Figure 4A:
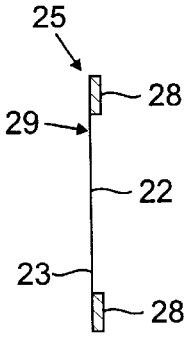
FIG. 4A is a side view of a focus grid assembly used in the display of FIG. 1.
Figure 4B:
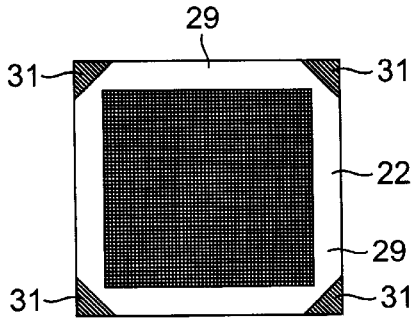
FIG. 4B is front view of the focus grid assembly of FIG. 4A after preparation for application of a dielectric material to be coated on portions of a surface of the assembly.

Thus, more particularly, the field emission display 10 includes a plurality of cathodes 12, an anode 14 having a plurality of cathodoluminescent dots or stripes 16; a plurality of control or gate electrodes 18 for controlling the flow of electrons between the cathodes 12 and the anode; and, a focus grid assembly 25 (FIG. 2). The focus grid assembly 25 comprises: a frame 28; and, a focus grid 22 affixed to the frame 28. The focus grid 22 comprises the apertured, conductive sheet (i.e., a mesh screen) 23, affixed to frame 28, and disposed between the anode 14 and the plurality of cathodes 12. Each cathodoluminescent dot or stripe 16 may be a different one of three colors, for example, or any other desired combination of colors, as in a color display, or may be the same color, as in a monochromatic display. Each one of the cathodes 12 comprises a plurality of sets, or pixels 21 of field emitters 24.

As noted above, the focus grid 22 comprises an apertured conductive sheet 23. More particularly, the focus grid 22 includes a conductive sheet 23 having a plurality of apertures 20 formed therein and arranged in an array in the central, interior region of the sheet 23. Each aperture 20 is associated with a corresponding one of the sets, or pixels 21 of the plurality of field emitters 24. More particularly, each one of the apertures 20 is disposed over (i.e., coaxial with) the corresponding set, or pixel 21 of field emitters 24.

The apertures 20 of the focus grid 22 are disposed between one of the cathodoluminescent stripes 16 and a set or pixel 21 of the field emitters 24. The focus grid 22 is biased at a voltage greater than the voltage of the field emitters 24 and less than the anode 14. The focus grid 22 intercepts any very high angle electrons thereby preventing them from getting to the anode 14, focuses the electrons that are not intercepted to a more localized, i.e., focused region on the anode 14. Further, because the electric field in the space between the cathode 12 and the focus grid 22 is less than the electric field between the focus grid 22 and the anode 14, the focus grid 22 increases the shielding, or isolation, between the cathode 12 and from the high voltage anode 14. These effects, and the focus grid 22 itself, are described in more detail in U.S. Pat. No. 5,543,691, issued Aug. 6, 1996, entitled "Field Emission Display with Focus Grid and Method of Operating Same", inventors Alan Palevsky and Peter F. Koufopoulos, assigned to the same assignee as the present invention, the subject matter thereof being incorporated herein by reference.

The cathodes 12 are disposed on an insulating substrate 26, here glass. The outer periphery of apertured conductive sheet 23 is welded to frame 28 to provide the focus grid assembly 25 (FIG. 2) in a manner described in co-pending patent application entitled "Field Emission Displays and Manufacturing Methods", Ser. No. 08/586,100, filed Jan. 16, 1996, Inventors R. Dennis Breen et al., assigned to the same assignee as the present invention, the subject matter thereof being incorporated herein by reference. Suffice it to say here, however, that the frame 28, with the sheet 23 welded to it, are supported (e.g., welded) on a stand-off 30 having legs which pass through the glass substrate 26. The stand-off 30 is welded to a support ring 32 on the bottom surface of the substrate 26, as shown. The sheet 23 is supported at the periphery thereof by the frame 28 with the interior portion of the sheet 23 being suspended in tension by the frame 28 over the field emitters 24 in a manner described in detail in the above-referenced patent application Ser. No. 08/586,100. That is, the sheet 23 has tensile forces in radial directions outward from its central interior region (i.e., the tensile forces are in the direction indicated by arrows 34, FIG. 2). Thus, the focus grid 22, because of the tensile forces provided in the apertured, conductive sheet 23 providing such focus grid 22 (and maintained in tension by the frame 28), is supported substantially equidistant over the sets or pixels 21 of field emitters 24 throughout its entire span across the frame 28 and therefore throughout its entire span across the sets, or pixels 21 of field emitters 24 as described in the above referenced co-pending patent application Ser. No. 08/586,100.

It should be noted that the focus grid 22 and the gate electrodes 28 are at about 100 to 200 volt differential and have about 150 microns nominal separation, d (FIG. 2), between them. However, during operation of the display 10 at power levels in the order of five watts, heating of the focus grid 22 may cause it to expand and, as a result, the focus grid 22 may buckle or sag in its inner region to such a degree that the focus grid 22 conductive sheet 23 and the gate electrodes 28 physically contact each other. Here, however, the dielectric material 19 prevents the focus grid 22 and the gate electrodes 28 from electrically coming in contact with each other. Here, the dielectric material 19 is a glass coating having a lead-oxide component.

More particularly, the apertures 20 in the focus grid (i.e., conductive sheet 23), here have a pitch of 195 microns and the apertures 20 have a diameter of about 100 to 110 microns. The dielectric material 19 is selected so that it may be processed at a temperature of 500 degree C. or less thereby preventing any substantial loss of tension between the conductive sheet 23 and the frame 28. Further, the dielectric material 19 is selected so that there is no substantial out-gassing of the dielectric material 19 which would poison the vacuum of the display 10 or which would contaminate the tips of the emitters 24. Further, the dielectric material 19 is selected to be thermally matched (i.e., in thermal expansion coefficient) with the conductive sheet 23, the cathode structure 11 and the glass 26 forming the bottom portion of a housing, not shown, for the display 10. Here, the dielectric material 19 a DuPont QQ550 glass encapsulant thinned with a solution of DuPont 8250 thinner and isopropyl alcohol to enable it to be applied in a spray painting, or air-brushing type application. The resistivity of the dielectric coating material 19 may be adjusted so that the time constant of the charge buildup is on the order of a video line time, typically 30 microseconds. This can be accomplished by doping DuPont QQ550-DG glass encapsulant with a thick film resistor paste such as Heraeus Cermalloy 8241-DG. In this way, enough charge builds up to prevent cross-talk, but deleterious effects of permanent charging are avoided. After such doping, the bulk resistivity of the dielectric coating material 19 should be greater than one megohm-centimeter.

Figure 5A:
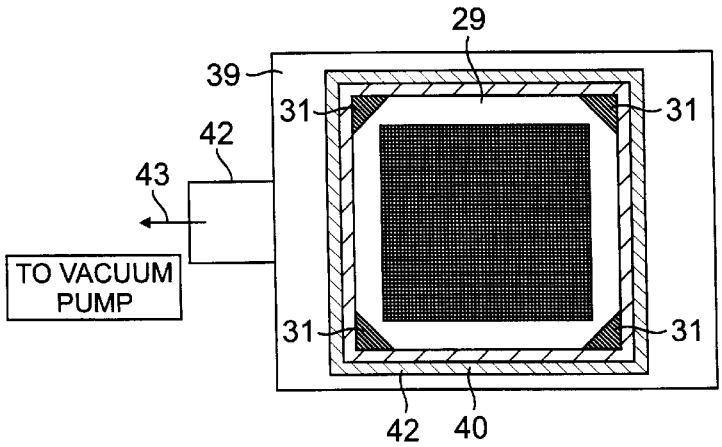
FIG. 5A is a front view of the focus grid assembly of FIG. 4B placed on a vacuum box for application of a dielectric material to be coated on the portions of a surface of the focus grid assembly.
Figure 5B:
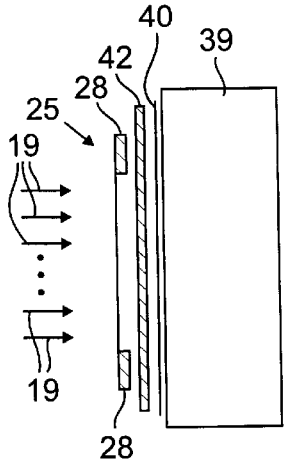
FIG. 5B is an exploded, side view of FIG. 5A with arrows representing the dielectric material being spray deposited on portions of a surface of the focus grid assembly.
Figure 6A:
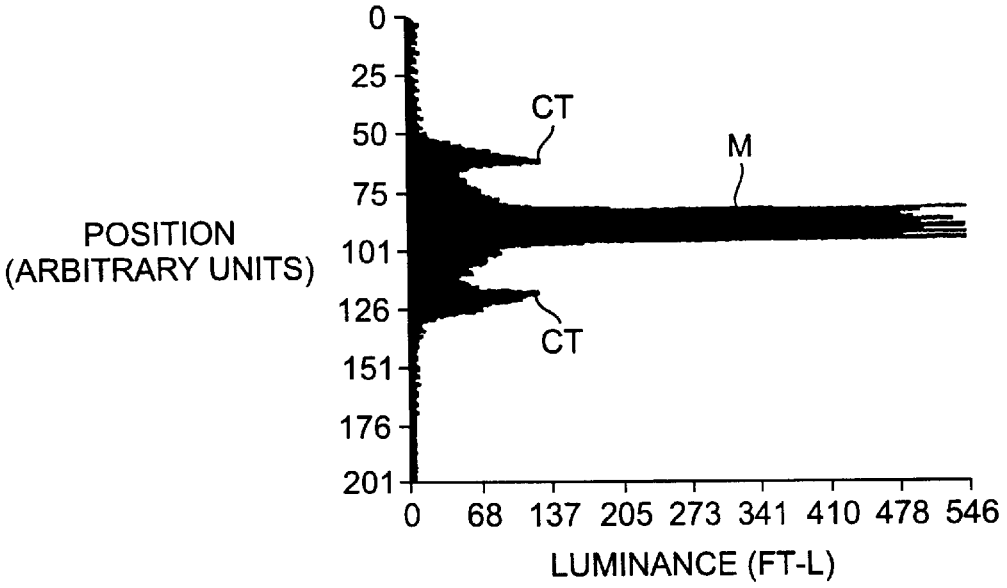
FIGS. 6A and 6B show the effect of the dielectric material on the focus grid in reducing cross-talk.
Figure 6B:
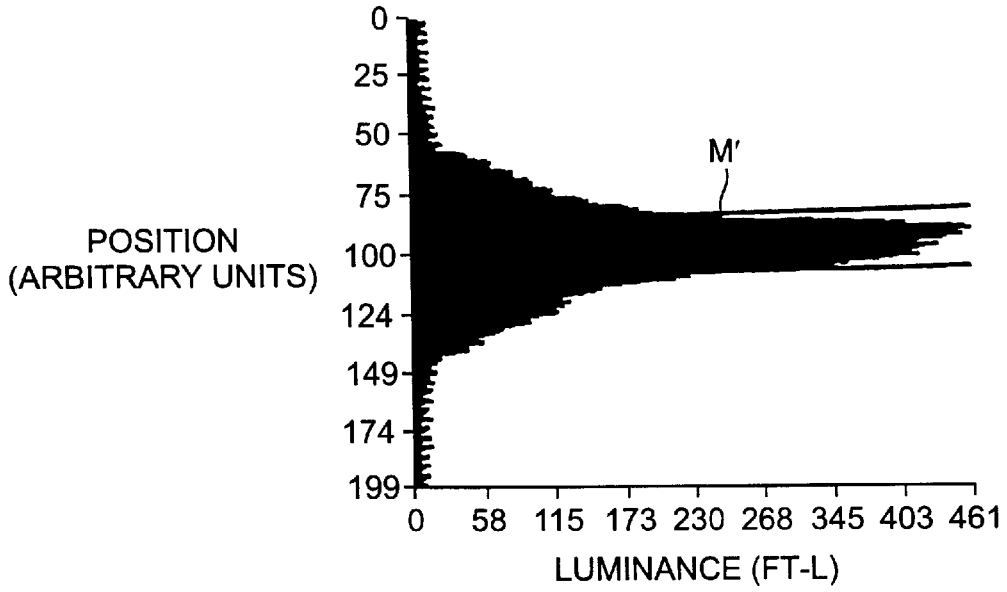

The focus grid 22 is processed as follows: After being welded under tension to frame 28 to form the grid assembly 25, as described in the above referenced patent application, Ser. No. 08/586,100, the focus grid 22 is cleaned using an ultrasonic cleaner. Referring to FIGS. 6A and 6B, the corners of the cathode structure 11 facing surface 29 of the focus grid 22 are masked with tape 31 to prevent their coating with the dielectric material 19 thus enabling the corners to be welded to the studs 30 (FIG. 2). The focus grid assembly 25 is mounted over the opening of a vacuum box 39, as shown in FIGS. 5A and 5B. More particularly, a coarse metal screen 40 (e.g., having holes with about a ⅛ inch diameter and a pitch of ¼ inch) is placed in front of the vacuum box 39 opening. A porous foam pad 42 is placed in front of the coarse metal screen 40, as shown in FIGS. 5A and 5B. The foam pad 42 acts as a diffuser. The vacuum box 39 has an exhaust port coupled to a vacuum pump 42, as shown. An air-brush, spray gun (e.g., air-brush), not shown, loaded with a sufficient supply of the solution of dielectric material 19 is used to spray the solution of dielectric material 19 onto the exposed portions of the focus grid 22. The solution is here the DuPont QQ550 paste material diluted with DuPont 8250 thinner and isopropyl alcohol to obtain a solution of proper viscosity. As the air is pulled towards the conductive sheet 23, the dielectric material 19 is intercepted by the conductive sheet 23 to form a deposition on surface 29 thereof while the dielectric material 19 passes through the apertures 20 with sufficient velocity and droplet size to prevent the apertures 20 from becoming clogged by the dielectric material 19 drawn therethrough. Thus, the air is drawn through the apertures 20 in the focus grid 22 at a very high velocity. That is, the air is sucked through the apertures 20 in the focus grid 22 to keep such apertures open, with any sprayed dielectric material 19 getting pulled through the apertures 20 by the vacuum. The spray gun, not shown, focus grid assembly 25, and vacuum box 39 are all disposed in a "glove box", not shown, equipped with hand sleeves and filters to prevent lint, etc. from contaminating the process (i.e., filtered air is used). The dielectric material 19 droplet size must be smaller than size of the apertures 20 in the focus grid 22 to prevent the apertures 20 from clogging. The size of the droplets is regulated by the rate at which the dielectric material 19 is sprayed. The thickness may be determined by weighing the focus grid 22 before the spraying operation and then monitoring its weight during the spraying operation. When the weight increases by between 0.5 to 0.8 grams for a 4 inch by 4 inch focus grid area conductive sheet 23, the spraying is terminated for producing about a 25 micron thick dielectric layer 19.

After spraying on the dielectric material 19, the focus grid assembly 25 is removed from the "glove box", not shown, and the vacuum box 39 and placed in an oven at 50 degrees C. to dry the diluting materials. Next, the masking is removed and the dielectric material 19 coated focus grid assembly 25 is placed in an air atmosphere oven at a temperature of about 500 degrees C. to fire the dielectric material 19. Thus, during firing, the coated dielectric particles in material 19 melt and flow together and develop adhesion to the conductive focus grid 22 without flowing into apertures 20. The assembly 25, with the dielectric material 19 coated focus grid 22 welded to the frame 28, as described in the pending patent application Ser. No. 08/586,100, are supported on a stand-off 30, as described above.

Referring now to FIGS. 6A and 6B, a comparison of monochrome line profile with and without the dielectric material is presented, FIG. 6A showing cross-talk effects by illuminations CT in addition to the main illumination, M, without the dielectric material 19 and FIG. 6B showing the effect of the dielectric material 19 in eliminating the cross-talk illuminations (CT) and leaving only a single main illumination, M'.

Figure 7:
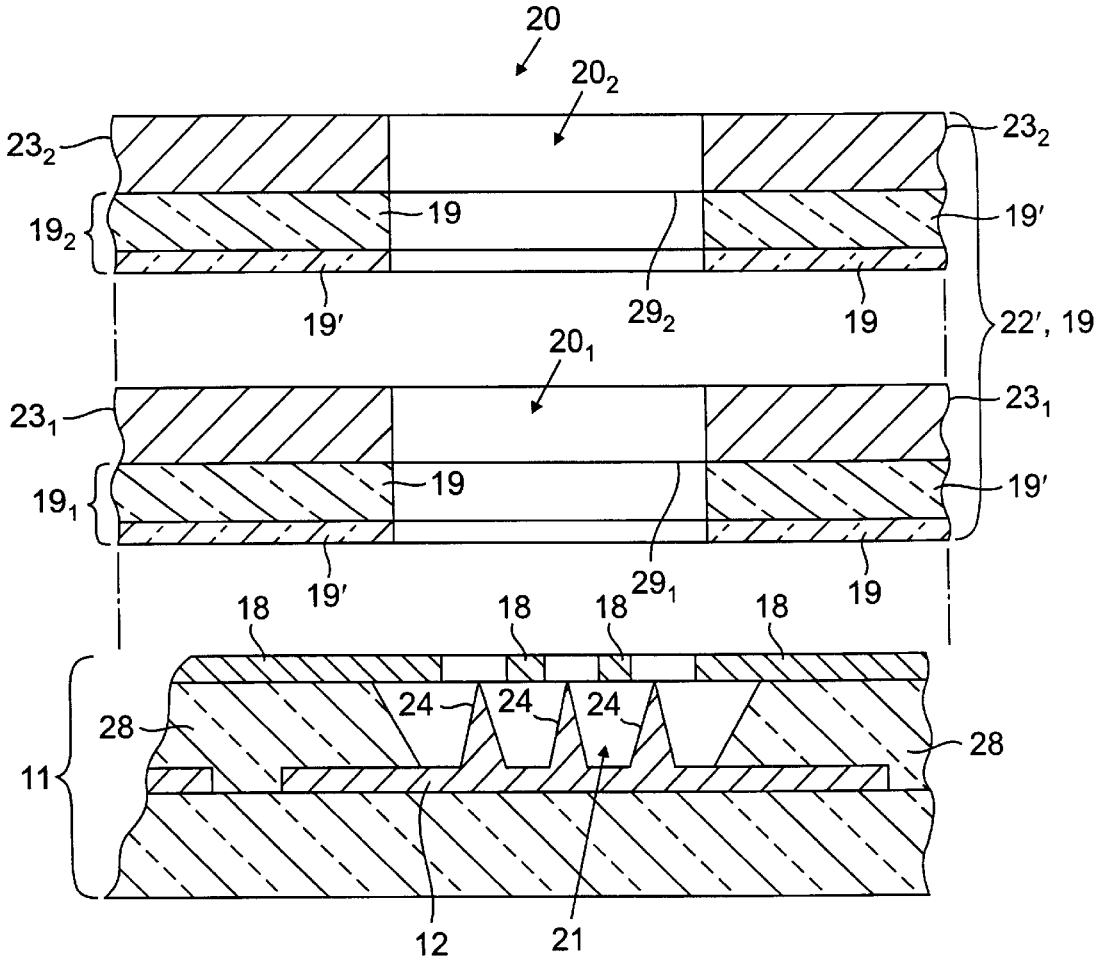
FIG. 7 is an exploded view of a portion of the display of FIG. 1 in accordance with an alternative embodiment of the invention.
Figure 8:
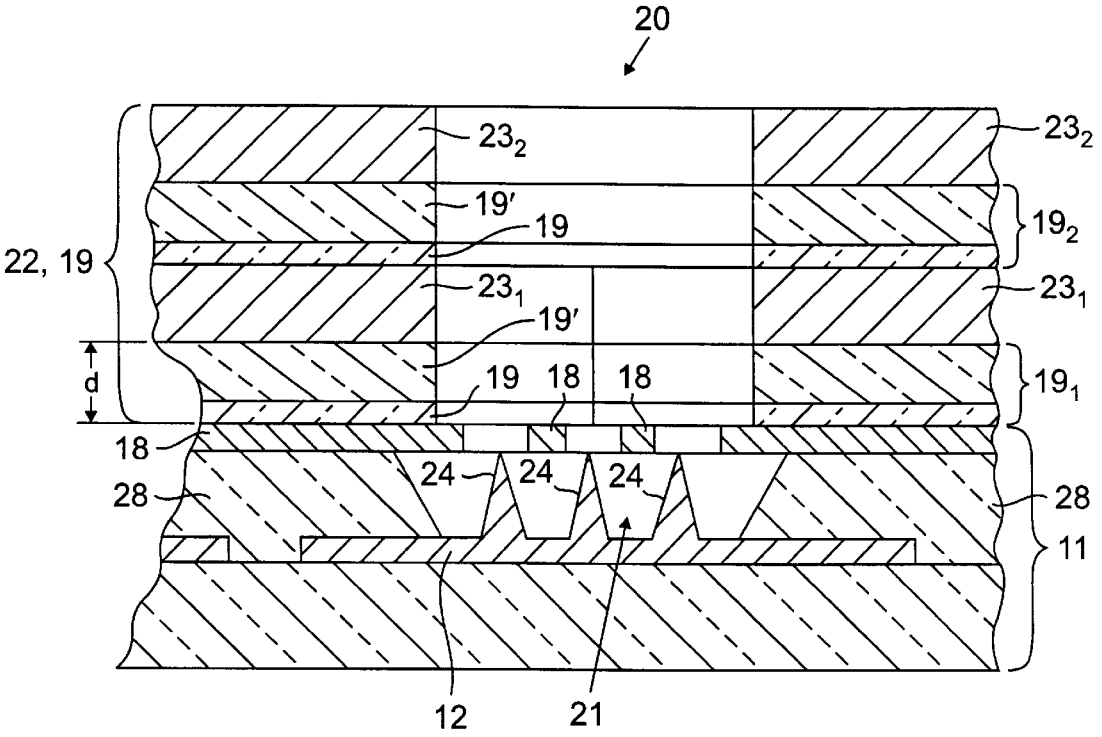
FIG. 8 is a non-exploded view of the portion of the display shown in FIG. 7.

Referring now to FIGS. 7 and 8, here a laminated focus grid 22' is shown mounted on the cathode structure 11. The laminated focus grid 22' includes a pair of substantially identical conductive sheets $\mathbf{23}_1$, $\mathbf{23}_2$ having aligned apertures $\mathbf{20}_1$, $\mathbf{20}_2$, respectively to provide the aperture 20 in the focus grid 22'. Dielectric materials $\mathbf{19}_1$, $\mathbf{19}_2$ are disposed on the cathode structure 11 facing surfaces $\mathbf{29}_1$, $\mathbf{29}_2$ respectively, of the conductive sheets 231, $\mathbf{23}_2$, respectively, as shown. The dielectric material $\mathbf{19}_1$, is bonded to the upper surface 50 of the conductive sheet $\mathbf{23}_1$ and the dielectric material $\mathbf{19}_1$ is bonded to the gate electrodes 18. Thus, the space between the gate electrodes 18 and the focus grid 22' is filled with solid dielectric material $\mathbf{19}_1$ resulting is a structure which prevents electrical contact between the conductive sheets $\mathbf{23}_1$ and $\mathbf{23}_2$ with the gate electrodes 18 and which prevents cross-talk.

Here, the frame 28 is eliminated and the focus grid 22' is directly bonded to the cathode structure 11, as shown more clearly in FIG. 8. The distance between the emitter structure 11 facing surface $\mathbf{29}_1$ and the gate electrodes 18 is here 75 microns, and the distance between the emitter structure 11 facing surface 292 is here 225 microns.

Each one of the sheets $\mathbf{23}_1$ and $\mathbf{23}_2$ is coated with a dielectric material 19' by means of the same spray deposition process used for dielectric material 19 described above in connection with FIGS. 4A, 4B, 5A and 5B. Dielectric material 19' is selected so that it may be processed at 600° C. to prevent flow during the lamination processed described below. Further, the dielectric material 19' is selected so that there is no substantial outgassing of the dielectric material 19' which would poison the vacuum of the display or which would contaminate the tips of the emitters 24. Further, the dielectric material 19' is selected to be thermally matched (i.e., in thermal expansion coefficient) with the conductive sheet 23, the cathode structure 11 and the glass 26 forming the bottom portion of the housing, not shown, for the display 10. Here, the dielectric 19' is a mixture of DuPont QQ550 glass encapsulant and DuPont 9370 dielectric thinned with DuPont 8250 thinner and isopropyl alcohol to enable it to be applied in a spray paint, or air-brushing type application.

After spraying on the dielectric 19' and drying, as described above in connection with FIGS. 4A, 4B, 5A, and 5B, the dielectric material 19' coated grids $\mathbf{23}_1$, $\mathbf{23}_2$ are placed in an air atmosphere oven at a temperature of about 600 degrees Centigrade to fire the dielectric material 19'. Thus, during firing, the coated dielectric particles in the dielectric material 19' melt and flow together and develop adhesion to sheets $\mathbf{23}_1$, $\mathbf{23}_2$ without flowing into apertures $\mathbf{20}_1$ and $\mathbf{20}_2$. Here, the thickness of each of the dielectric material 19' layers is 62.5 microns.

Next, a glaze dielectric coating of material 19 described above and processed as described above in connection with FIGS. 4A, 4B, 5A and 5B, here having a thickness of 12.5 microns, is applied to the dielectric material 19', as shown in FIGS. 7 and 8. The glazed coatings 19 are, after being fired, stacked on the cathode structure 11 as shown in FIG. 8. Weights, not shown, are applied to the top surface of the conductive sheet $\mathbf{23}_2$ while the entire structure is heated in a vacuum furnace to 450 degrees C. to soften the glazed materials 19 so that the conductive sheets $\mathbf{23}_1$, $\mathbf{23}_2$, dielectric materials $\mathbf{19}_1$, $\mathbf{19}_2$ and cathode structure 11 are all bonded together into a unitary, laminated structure as shown in FIG. 8. The total thickness of the focus grid-dielectric material structure bracketed and identified by 22', 19 is here 300 microns.

Other embodiments are within the spirit and scope of the appended claims. For example, the laminated focus grid 22' may be used as a multi-element focus grid because each conductive sheet $\mathbf{23}_1$, $\mathbf{23}_2$ is electrically insulated from the other and therefore may be at different electrical potentials.

What is claimed is:

1. A method for forming a grid for a field emission display, comprising the step of spraying a dielectric material towards a surface of the grid while a vacuum draws the spray from the surface through apertures in the grid.

2. A method for forming a grid assembly for a field emission display, comprising the steps of:

mounting the grid over an opening of a vacuum box, such vacuum box having an exhaust port coupled to a vacuum pump to pull air front a front surface of the grid towards a rear surface of the grid;

spraying a dielectric material towards the front surface of the grid onto the exposed portions of the front surface of the grid while the vacuum draws portions of the spray material through apertures in the grid.

3. The method recited in claim 2 wherein the pump is operated so that the air draws the dielectric material through the apertures with sufficient velocity and droplet size to prevent the apertures from becoming clogged by the dielectric material 19 drawn therethrough.

4. The method recited in claim 3 including the step of firing the dielectric material.

* * * * *